US006283748B1

(12) United States Patent
Orbeck et al.

(10) Patent No.: US 6,283,748 B1
(45) Date of Patent: Sep. 4, 2001

(54) CONTINUOUS PUSHER FURNACE HAVING TRAVELING GAS BARRIER

(75) Inventors: Gary Orbeck, Windham, NH (US); John Thayer, Lancaster, PA (US)

(73) Assignee: BTU International, Inc., North Billerica, MA (US)

( * ) Notice: Subject to any disclaimer, the term of this patent is extended or adjusted under 35 U.S.C. 154(b) by 0 days.

(21) Appl. No.: 09/438,073

(22) Filed: Nov. 10, 1999

Related U.S. Application Data

(60) Provisional application No. 60/139,612, filed on Jun. 17, 1999.

(51) Int. Cl.[7] ..... F27D 3/04

(52) U.S. Cl. ..... 432/126; 432/121

(58) Field of Search ..... 432/121, 125, 432/126, 129, 153, 128; 219/388, 402; 266/176, 177, 180; 414/147, 150

(56) References Cited

U.S. PATENT DOCUMENTS

| | | | | |
|---|---|---|---|---|
| 3,584,847 | * | 6/1971 | Hammond, Jr. et al. | 432/126 |
| 3,982,887 | | 9/1976 | Kendziora et al. | 432/128 |
| 4,022,570 | * | 5/1977 | Ross, Jr. et al. | 432/129 |
| 4,029,489 | | 6/1977 | Froberg et al. | 65/136 |
| 4,073,874 | | 2/1978 | Fukushima | 423/500 |
| 4,194,990 | | 3/1980 | Pieters et al. | 252/441 |
| 4,205,935 | | 6/1980 | Edler et al. | 414/152 |
| 4,263,163 | | 4/1981 | Ross | 252/301.1 W |
| 4,389,332 | | 6/1983 | Ross | 252/378 R |
| 4,416,623 | | 11/1983 | Takahashi | 432/36 |
| 4,421,481 | * | 12/1983 | Holz et al. | 432/126 |
| 4,457,703 | | 7/1984 | Ross | 432/13 |
| 4,496,477 | | 1/1985 | Ross | 252/629 |
| 4,518,417 | | 5/1985 | Lugscheider et al. | 75/10 R |
| 4,574,182 | | 3/1986 | Pescatore et al. | 219/388 |
| 4,586,898 | | 5/1986 | Orbeck | 432/122 |
| 4,627,814 | | 12/1986 | Hattori et al. | 432/128 |
| 4,847,465 | * | 7/1989 | Toyama et al. | 219/85.1 |
| 4,932,864 | * | 6/1990 | Miyabe | 432/128 |
| 4,966,547 | * | 10/1990 | Okuyama et al. | 432/9 |
| 5,078,368 | * | 1/1992 | Hemsath | 266/236 |
| 5,314,330 | * | 5/1994 | Orbeck | 432/128 |
| 5,338,008 | * | 8/1994 | Okuno et al. | 266/105 |
| 5,440,101 | * | 8/1995 | Cox et al. | 219/388 |
| 5,443,383 | * | 8/1995 | Kuehn | 432/122 |
| 5,542,595 | * | 8/1996 | Gibson | 228/207 |
| 5,714,113 | * | 2/1998 | Gitman et al. | 266/182 |
| 5,788,921 | * | 8/1998 | Gitman et al. | 266/225 |
| 5,843,368 | * | 12/1998 | Gitman et al. | 266/182 |
| 5,858,302 | * | 1/1999 | Gitman et al. | 266/182 |

FOREIGN PATENT DOCUMENTS

| | | |
|---|---|---|
| 906071 | 3/1954 | (DE) . |
| 1758132 | 12/1970 | (DE) . |
| 2045776 | 3/1972 | (DE) . |
| 505035 | 7/1920 | (FR) . |
| 975584 | 11/1964 | (GB) . |
| WO 92/08940 | 5/1992 | (WO) . |

* cited by examiner

*Primary Examiner*—Denise L. Ferensic
*Assistant Examiner*—Gregory A. Wilson
(74) *Attorney, Agent, or Firm*—Weingarten, Schurgin, Gagnebin & Hayes LLP

(57) ABSTRACT

A continuous pusher furnace includes a product carrier assembly forming a traveling gas barrier. The product carrier assembly comprises a pusher plate disposed to receive product thereon and a gas barrier extending upwardly from the pusher plate. The perimeter of the gas barrier is sized and configured to fit within a vestibule between heating chambers in the furnace with a clearance gap with the vestibule selected to increase a gas flow velocity through the vestibule sufficient to overcome a gas diffusion velocity through the vestibule in a direction opposite to the gas flow. In this manner, gas is unable to diffuse into an upstream heating chamber. In an alternative embodiment, an exhaust outlet may also be provided in the vestibule or chamber to exhaust gas from upstream and downstream heating chambers from the furnace.

20 Claims, 3 Drawing Sheets

FIG. 4
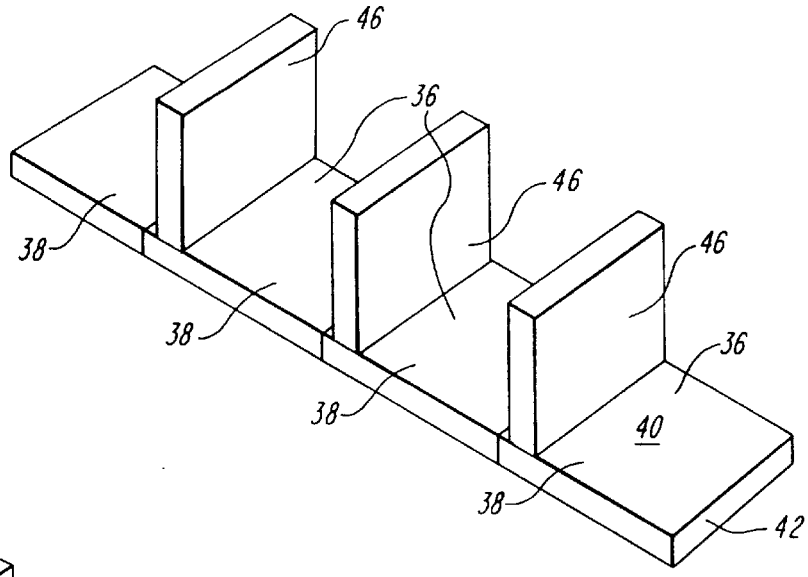
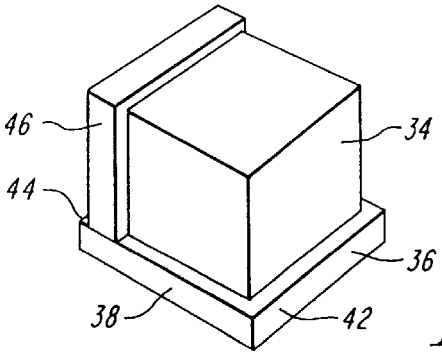
FIG. 5
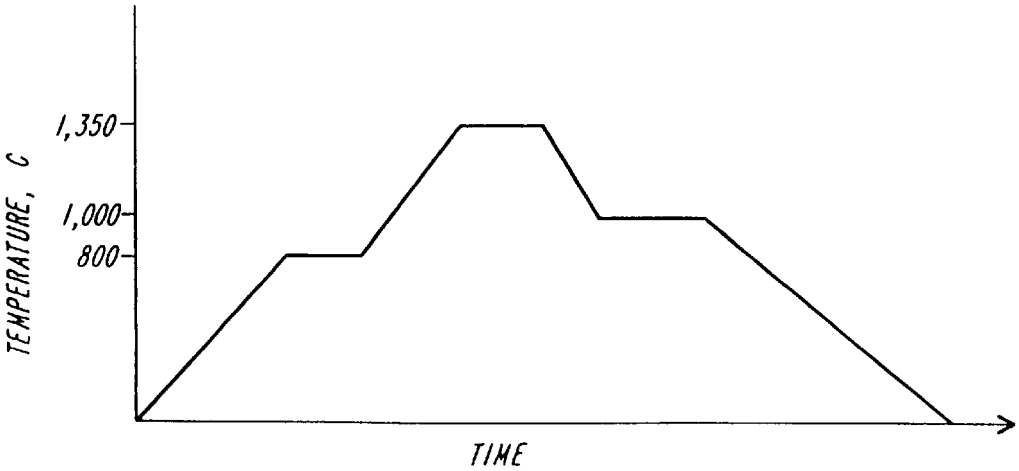
FIG. 6

CONTINUOUS PUSHER FURNACE HAVING TRAVELING GAS BARRIER

CROSS REFERENCE TO RELATED APPLICATIONS

This application claims priority under 35 U.S.C. § 119(e) of U.S. Provisional Application Ser. No. 60/139,612 filed Jun. 17, 1999, the disclosure of which is incorporated by reference herein.

STATEMENT REGARDING FEDERALLY SPONSORED RESEARCH OR DEVELOPMENT

N/A

BACKGROUND OF THE INVENTION

Continuous furnaces are used for a variety of applications, such as the manufacture of electronic components. These furnaces often have a set of thermal or heating chambers within each of which the temperature and composition of the atmosphere are controlled. Product is advanced sequentially through each chamber at a determined rate to achieve a desired thermal and atmosphere profile.

Product may be advanced through continuous furnaces in various manners, for example, in one type of continuous furnace, the product sits on a metal mesh belt which pulls the product through the furnace. In another type, a continuous pusher furnace, the product is placed on plates or carriers or boats that are pushed into the entrance of the furnace. Each subsequent plate pushes the plate in front of it. A line of contacting plates is advanced by pushing on the rearmost plate in the line. Often, it is desirable to operate two chambers within a continuous furnace at different atmospheres that must be kept separated. Typically, the chambers are spaced by tunnels or vestibules. Often doors at the entrance and exit of the chambers are provided to retain the atmosphere within the chamber. These doors, however, are costly and complex. To close the door in a continuous pusher furnace, product carriers in a contacting line must be separated, for example, by pushing the carrier at the head of the line at 90° to move it off the line of travel and into a purge chamber or furnace section. A door is then closed behind the isolated carrier and the chamber purged. The carrier may be advanced to the next chamber by another pusher along a line offset from the first line. This procedure must be repeated for each carrier. This requires additional furnace length, cost, and multiple pushers.

SUMMARY OF THE INVENTION

In the present invention, a continuous pusher furnace incorporates a traveling gas barrier to create a barrier to open gas travel between the furnace chambers. During operation of the furnace, gas flows from one heating chamber, an upstream chamber, to an adjacent heating chamber, a downstream chamber. At the same time, gas may try to diffuse from the downstream heating chamber toward the upstream heating chamber, against the gas flow. The magnitude of the diffusion velocity could be greater than the magnitude of the gas flow velocity, in which case the composition of the atmosphere in the upstream chamber could be altered as the diffusing gas enters the upstream chamber. In the present invention, diffusion of gas from the downstream chamber into the upstream chamber is prevented by a product carrier assembly that incorporates a gas barrier that travels with product through the furnace. The gas barrier ensures sufficient downstream gas velocity to overcome diffusion.

More particularly, the continuous pusher furnace has at least one heating chamber and typically a plurality of heating chambers. Vestibules interconnect the heating chambers. Entrance and exit vestibules are also typically provided. Gas containment from the process chambers to the outside through the entrance and exit vestibules operates in the same manner as chamber-to-chamber separation.

Each product carrier assembly comprises a pusher plate disposed to receive product thereon and a gas barrier extending upwardly from the pusher plate. The gas barrier has a perimeter sized and configured to fit within the vestibule with a clearance gap between the perimeter and the vestibule walls that increases the gas flow velocity through the vestibule sufficiently to overcome the gas diffusion velocity through the vestibule in a direction opposite to the gas flow. The traveling gas barrier of the present invention thus prevents diffusion of gas into the upstream chamber. The traveling gas barrier allows the furnace heating chambers to be aligned along a single line, thereby minimizing the size of the furnace. The need for complex doors and multiple pushers is eliminated, and product may be moved through the furnace more rapidly and efficiently.

In an alternative embodiment, one or more exhaust outlets are additionally provided in the vestibule or chambers to exhaust gas from both the upstream chamber and the downstream chamber out of the furnace. The length of the vestibule is selected to allow sufficient opportunity for the gas to be exhausted through the exhaust outlets.

DESCRIPTION OF THE DRAWINGS

The invention will be more fully understood from the following detailed description taken in conjunction with the accompanying drawings in which:

FIG. 4 is an isometric view of a row of gas barrier pusher plates according to the present invention;

FIG. 5 is an isometric view of a gas barrier pusher plate with product according to the present invention; and FIG. 6 is a process profile for the firing of ceramic capacitors.

DETAILED DESCRIPTION OF THE INVENTION

Figure 1:
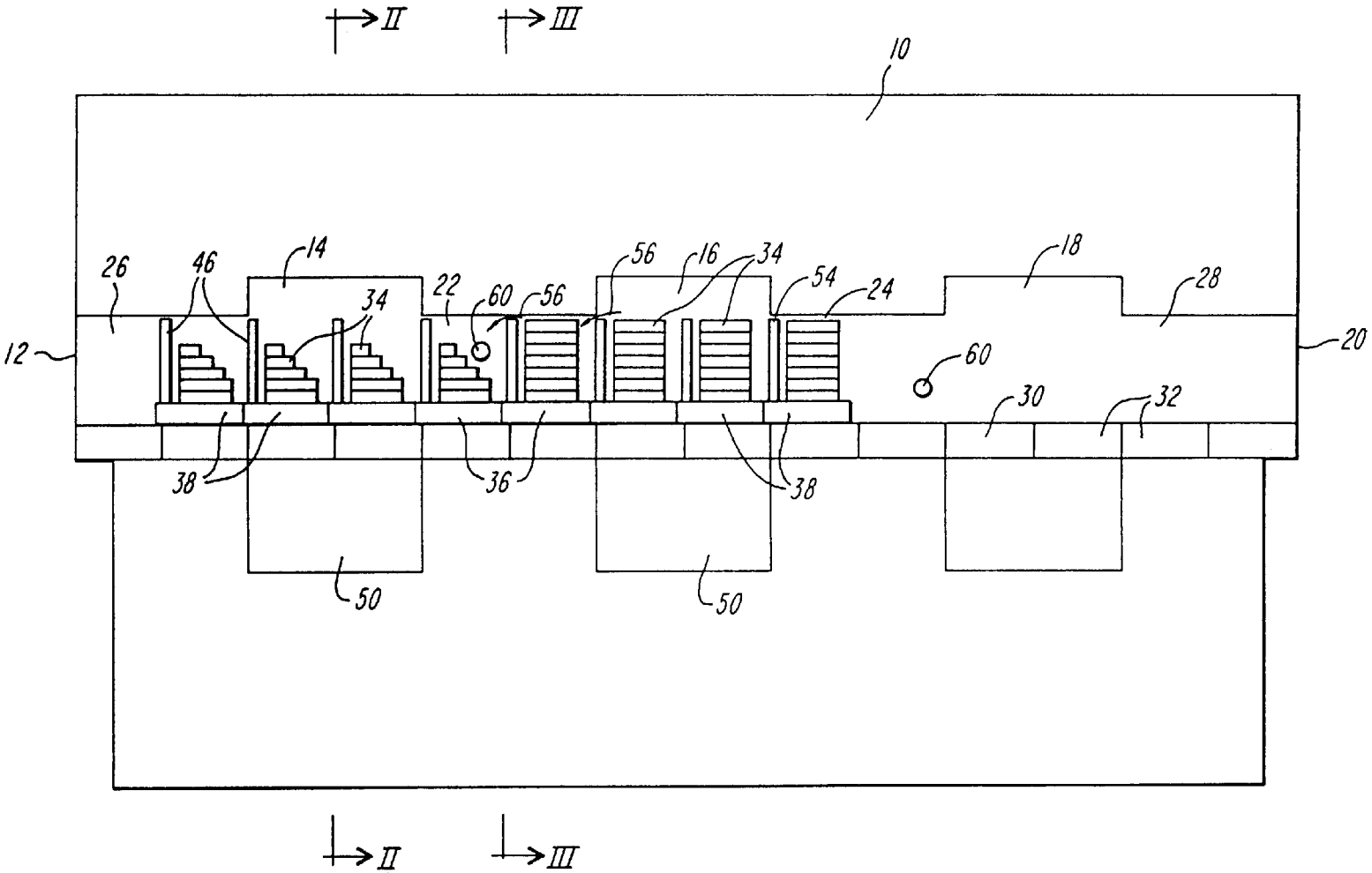
FIG. 1 is a cross-sectional view of a continuous pusher furnace with gas barrier pusher plates according to the present invention shown halfway down the furnace length.
Figure 2:
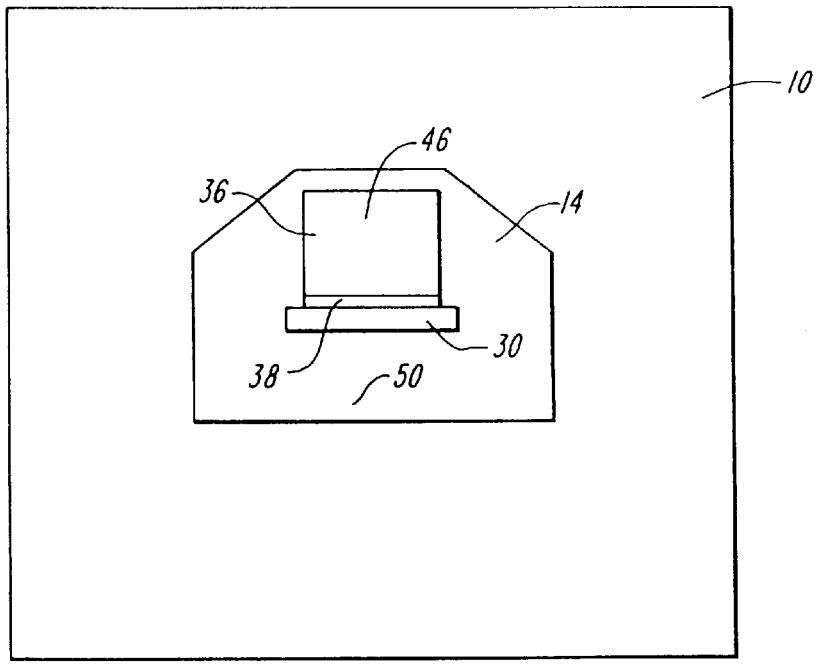
FIG. 2 is a cross-sectional view taken along line II—II of FIG. 1.
Figure 3:
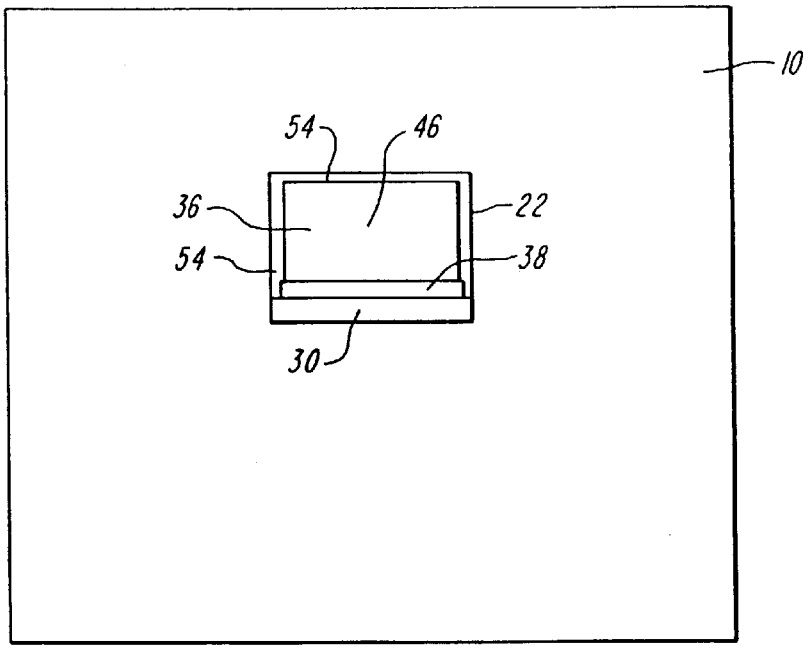
FIG. 3 is a cross-sectional view taken along line III—III of FIG. 1.

FIGS. 1–5 illustrate a continuous pusher furnace 10 of the present invention having an entrance 12, a number of thermal or heating chambers 14, 16, 18, and an exit 20. Vestibules 22, 24 or tunnels interconnect the heating chambers 14, 16, 18. An entrance vestibule 26 is provided between the entrance 12 and the first heating chamber 14, and an exit vestibule 28 is provided between the last heating chamber 18 and the exit 20. Although three heating chambers are shown, one or any other number of heating chambers may be provided, depending on the application. The vestibules 22, 24, 26, 28 are the same size or smaller in cross-sectional area than the heating chambers 14, 16, 18, as best seen in a comparison of FIGS. 2 and 3. A hearth surface 30, which may be formed from a series of hearth plates 32, extends the length of the furnace from the entrance 12 to the exit 20. Product 34 resting on product carrier assemblies 36 is pushed along the hearth surface 30 from the entrance 12 through the heating chambers 14, 16, 18 and vestibules 22, 24, 26, 28, to the exit 20. Each heating chamber functions in a manner known in the art to heat product therein to the desired temperature at a predetermined composition of atmosphere.

Each carrier assembly 36 comprises a pusher plate 38 and gas barrier 46 that slide over the hearth surface 30. Product 34 rests on the flat surface 40 of the pusher plate. The pusher plate is typically square or rectangular. The plate typically has a front or leading edge 42 facing the direction of product travel and a rear or trailing edge 44 that is contacted by a pusher or a subsequent pusher plate. The gas barrier 46 extends upwardly from the pusher plate 38. The gas barrier 46 is formed as a wall that extends in a plane transverse to the direction of product travel. Preferably, the gas barrier is located near or at the trailing edge 44 of the pusher plate. The gas barrier may also extend upwardly from other locations, as long as sufficient area is provided on the pusher plate to retain product. For example, the gas barrier may extend upwardly from at or near the leading edge 42. In another configuration, the gas barrier may extend upwardly from a central location, leaving product area in front of and behind the gas barrier. The gas barrier is attached to the pusher plate so that it is able to travel with the pusher plate as the carrier assembly and the product thereon is advanced through the furnace.

During operation of the furnace, gas flows from one heating chamber, an upstream chamber, for example, chamber 16, through the adjacent vestibule 22 to the next closest downstream heating chamber, for example, chamber 14. It will be appreciated that the gas flow may be in the same direction as the product travel or in the opposite direction; the terms upstream and downstream are used in this context to refer to the direction of gas flow. At the same time, gas attempts to diffuse in the opposite direction from the gas flow, that is, from the downstream heating chamber 14 to the upstream heating chamber 16.

For example, lacking the present invention, trace hydrogen gas in the downstream heating chamber 14 may diffuse upstream against the flow of the gas. The magnitude of the diffusion velocity may also be greater than the magnitude of the flow velocity. In this case, over time, the composition of the atmosphere in the upstream heating chamber 14 may be altered by introduction of gas from the downstream heating chamber 16. This alteration of the atmosphere may or may not be acceptable to a given application.

The carrier assembly 36 of the present invention provides a barrier to prevent gas diffusion against the gas flow. The gas barrier 46 is sized and configured to fit within the vestibule with only a small clearance gap 54 between the vestibule walls and roof and the perimeter of the gas barrier. Gas flowing through the vestibule must therefore pass through this small gap, indicated by the arrows 56 in FIG. 1. Because of the reduced cross-sectional area and the length of the gas barrier along the gas flow path caused by the small gap, the velocity of the gas increases as the gas flows over and around the gas barrier. The smaller the cross-sectional area of the gap, the greater the increase in gas flow velocity. The gap size is selected to increase the magnitude of the gas flow velocity, over a calculated length, sufficiently to be greater than the magnitude of the diffusion velocity. In this manner, gas is unable to diffuse upstream against the gas flow.

The size and length of the gap 54 is chosen based on several considerations to achieve a sufficiently large gas flow velocity. One factor is the size of the gas supply used in the process. A larger gas supply provides a greater gas flow velocity. Thus, for large gas supplies, a larger gap may suffice to increase the gas flow velocity sufficiently to overcome the gas diffusion velocity. Another factor is the tolerance achievable with the material from which the gas barrier is formed. For example, a brick material cannot provide as close a tolerance as a metal material. Thus, if a small gap with a tight tolerance is needed, a suitable material to achieve that tolerance should be selected. A further factor is the amount, if any, of diffused gas that can be tolerated in the upstream heating chamber.

The pusher plate and the gas barrier may be made of any suitable material, such as a metal or a ceramic or other refractory, that can withstand the environment inside the furnace, as is known in the art. The gas barrier may be attached to the pusher plate in any suitable manner, such as with screws, adhesive, or any other fastening device or method or by retention in a retaining groove. The gas barrier may be removable from the pusher plate if desired. The gas barrier need not be fixedly attached to the pusher plate. It could be gravity-loaded onto the pusher plate. The gas barrier and the pusher plate may also be formed as a single unitary member. Also, the barrier may be a separate piece from the pusher plate, for example, to be inserted between each pusher plate.

In the situation described above, gas flowing from the upstream chamber is able to enter the downstream chamber. In many applications, this mixing of atmospheres in the downstream chamber is acceptable. In some applications, however, it is not desirable to allow the upstream gas to enter the downstream chamber. Thus, in an alternative embodiment, one or more exhaust outlets 60, and alternate gas inlets may be provided in the vestibule or the firing chambers. In FIG. 1, a single exhaust outlet is shown in each vestibule 22 and 24. Some or all of the upstream gas is exhausted through this outlet. Thus, when the exhaust outlet is used in conjunction with the traveling gas barrier of the present invention, both upstream gas may be prevented from entering the downstream chamber and downstream gas may be prevented from entering the upstream chamber. The exhaust outlet may be any suitable exhaust outlet, for example, open to the atmosphere or incorporating a fan or vacuum source, as known in the art. The length of the vestibule is selected to allow sufficient exhaust outlets to remove the gases along with a given number of gas barriers in the vestibule.

The present invention may be further understood in conjunction with an example, such as the manufacture of ceramic capacitors. FIG. 6 illustrates a typical firing profile of ceramic capacitors. Three heating chambers are used. The product is held in a reducing atmosphere in a first heating chamber, for example chamber 14, of nitrogen and trace hydrogen at 800 C for a predetermined time. There can be only a negligible amount of oxygen in this chamber (for example, partial pressure of oxygen may be approximately $10^{-20}$ atm). The product is advanced to a second or center heating chamber, chamber 16, for firing at 1350 C in a nitrogen and oxygen and hydrogen atmosphere. The partial pressure of the oxygen in this chamber is approximately $10^{-11}$ to $10^{-12}$ atm. This is followed by reoxidation in a third or last heating chamber, chamber 18, at 1000 C in an atmosphere of nitrogen and a greater amount of oxygen. The partial pressure of the oxygen is approximately $10^{-4}$ atm.

In this process, gas tends to flow out of the center chamber 16 toward both the first heating chamber 14 and the last heating chamber 18. Hydrogen tends to diffuse from the first chamber 14 to the center chamber 16. The traveling gas barrier 46 of the present invention prevents this diffusion of hydrogen toward the center chamber 16. Although some dilution of the atmospheres in the first and last chambers 14, 18 with atmosphere from the center chamber 16 can be tolerated in this process, the exhaust outlets 60 in the vestibule between the first chamber and the center chamber and between the center chamber and the last chamber minimize this dilution.

The traveling gas barrier of the present invention may also be used to prevent room atmosphere from entering the first heating chamber 14 through the entrance vestibule 26 or to prevent room atmosphere from entering the last heating chamber 18 through the exit vestibule 28.

The invention is not to be limited by what has been particularly shown and described, except as indicated by the appended claims.

We claim:

1. A continuous pusher furnace comprising:

at least one heating chamber and at least one vestibule adjoining the heating chamber, and a hearth surface defining a product path through the heating chamber and through the vestibule; and a product carrier assembly comprising a pusher plate disposed to received product thereon and a gas barrier extending transversely across the product path and having a perimeter, the gas barrier sized and configured to fit within the vestibule with a clearance gap between the perimeter and the vestibule.

2. The furnace of claim 1, wherein the clearance gap and length are selected to increase a gas flow velocity through the vestibule sufficient to overcome a gas diffusion velocity through the vestibule in a direction opposite to the gas flow local to the perimeter of the gas barrier.

3. The furnace of claim 1, further comprising a plurality of product carrier assemblies.

4. The furnace of claim 1, wherein a cross-sectional area of the vestibule is smaller or the same size as the cross-sectional area of the heating chamber.

5. The furnace of claim 1, wherein the product path lies along a straight line from an entrance of the furnace to an exit of the furnace.

6. The furnace of claim 1, further comprising at least a second heating chamber, the vestibule interconnecting the at least one heating chamber and the second heating chamber.

7. The furnace of claim 6, wherein the product path lies along a straight line from the one heating chamber to the second heating chamber.

8. The furnace of claim 1, wherein the vestibule comprises an entrance vestibule located adjacent to a product entrance in the heating chamber.

9. The furnace of claim 1, wherein the vestibule comprises an exit vestibule located adjacent to a product exit in the heating chamber.

10. The furnace of claim 1, further including at least one exhaust outlet in the vestibule or furnace chamber.

11. The furnace of claim 10, wherein the vestibule is sufficiently long to allow all gas to be exhausted through the at least one exhaust outlet.

12. The furnace of claim 1, wherein the product carrier assembly is formed of a material capable of withstanding a heated environment in the furnace.

13. The furnace of claim 1, wherein the product carrier assembly is formed of a refractory material.

14. The furnace of claim 1, wherein the gas barrier extends upwardly from the pusher plate.

15. The furnace of claim 1, wherein the gas barrier is fixedly attached to the pusher plate.

16. The furnace of claim 1, wherein the gas barrier is gravity-loaded to the pusher plate.

17. The furnace of claim 16, wherein the gas barrier is fixedly attached or gravity-loaded to the pusher plate.

18. The furnace of claim 1, wherein the gas barrier is unitary with the pusher plate.

19. The furnace of claim 1, wherein the gas barrier is separate from the pusher plate.

20. A product carrier assembly for use with a continuous pusher furnace, the furnace comprising at least one heating chamber, at least one vestibule adjoining the heating chamber, and a hearth surface defining a product path through the heating chamber and through the vestibule, the product carrier assembly comprising:

a pusher plate having a surface configured to receive product thereon; and a gas barrier extending upwardly from the pusher plate and having upstanding side edges and a top edge, the gas barrier sized and configured to fit within the vestibule with a clearance gap between the side edges and the top edge selected to increase a gas flow velocity through the vestibule sufficient to overcome a gas diffusion velocity through the vestibule in a direction opposite to the gas flow;

wherein the pusher plate and the gas barrier are further formed of a material capable of withstanding a heated environment in the furnace.

* * * * *

UNITED STATES PATENT AND TRADEMARK OFFICE

CERTIFICATE OF CORRECTION

PATENT NO. : 6,283,748 B1
DATED : September 4, 2001
INVENTOR(S) : Gary Orbeck et al.

It is certified that error appears in the above-identified patent and that said Letters Patent is hereby corrected as shown below:

Column 5,
Line 19, “pusher furnace” should read -- furnace --;
Line 24, “pusher plate” should read -- plate --;
Line 29, “vestibule.” should read -- vestibule, wherein the clearance gap and length are seleted to increase a gas flow velocity through the vestibule sufficient to overcome a gas diffusion velocity through the vestibule in a direction opposite to the gas flow local to the perimeter of the gas barrier. --;
Lines 31-34, Claim 2 should be deleted;

Column 6,
Lines 18, 20, 22, 26 and 28, “pusher plate.” should read -- plate. --; and
After line 47, insert claim 21 as follows:
-- 21. The furnace of claim 1, wherein the furnace comprises a continuous pusher furnace. --.

Signed and Sealed this

Thirteenth Day of May, 2003

JAMES E. ROGAN
*Director of the United States Patent and Trademark Office*